US006205724B1

(12) United States Patent
Garling et al.

(10) Patent No.: US 6,205,724 B1
(45) Date of Patent: Mar. 27, 2001

(54) MULLION ANCHOR AND WATER DIVERTER FOR STOREFRONT FRAMING SYSTEMS

(76) Inventors: Phillip E. Garling, 5305 Bell View Rd., Rogers, AR (US) 72758; Paxton M. Ellis, 217 SE. 16th St., Bentonville, AR (US) 72712

( * ) Notice: Subject to any disclaimer, the term of this patent is extended or adjusted under 35 U.S.C. 154(b) by 0 days.

(21) Appl. No.: 09/182,092

(22) Filed: Oct. 29, 1998

(51) Int. Cl.[7] ..... E06B 7/14

(52) U.S. Cl. ..... 52/209; 52/204.1; 52/235; 52/302.1

(58) Field of Search ..... 52/209, 204.1, 52/204.2, 204.5, 235, 302.1, 302.6, 302.7, 730.3, 396.05, 533, 97, 238.1, 239, 243, 243.1, 301

(56) References Cited

U.S. PATENT DOCUMENTS

| | | | | |
|---|---|---|---|---|
| 3,690,079 | | 9/1972 | Hemminger . | |
| 3,866,369 | | 2/1975 | Paull . | |
| 4,276,729 | * | 7/1981 | Shiga et al. | 52/209 |
| 4,448,001 | | 5/1984 | Whitmyer et al. . | |
| 4,471,589 | * | 9/1984 | Schmidlin | 52/204.5 X |
| 4,597,235 | | 7/1986 | Olsen . | |
| 4,672,784 | | 6/1987 | Pohlar . | |
| 4,825,617 | * | 5/1989 | Kinoshita et al. | 52/235 X |
| 4,924,647 | | 5/1990 | Drucker . | |
| 4,984,402 | | 1/1991 | Davies . | |
| 4,991,823 | * | 2/1991 | Stanish, Jr. | 52/301 X |
| 5,009,051 | * | 4/1991 | Trezza | 52/714 X |
| 5,067,294 | * | 11/1991 | McGowan | 52/242 X |
| 5,123,212 | | 6/1992 | Dallaire et al. . | |
| 5,154,029 | | 10/1992 | Sturgeon . | |
| 5,212,914 | | 5/1993 | Martin et al. . | |
| 5,544,461 | * | 8/1996 | Sommerstein | 52/235 |

FOREIGN PATENT DOCUMENTS

| | | | | |
|---|---|---|---|---|
| 2-125046 | * | 5/1990 | (JP) | 52/235 |
| 2-157342 | * | 6/1990 | (JP) | 52/235 |

* cited by examiner

*Primary Examiner*—Carl D. Friedman
*Assistant Examiner*—Winnie Yip

(57) ABSTRACT

An anchor is disclosed for anchoring a vertical frame member to an adjacent condition and for diverting water away from an opening in the frame member. The apparatus includes a mounting bracket and a water diverter attached to the mounting bracket. A downward extending flange connected to the water diverter is configured to engage the frame member. When the mounting bracket is attached to the adjacent condition and the flange engages the frame member, the water diverter overlies the opening in the frame member to prevent water from entering the opening and to divert water away from the opening.

9 Claims, 7 Drawing Sheets

MULLION ANCHOR AND WATER DIVERTER FOR STOREFRONT FRAMING SYSTEMS

TECHNICAL FIELD

This invention relates generally to storefront framing systems and relates more specifically to the manner in which a vertical frame member of a storefront framing system is mounted within an opening in a masonry wall or other substrates.

BACKGROUND OF THE INVENTION

Storefront framing systems are well known and widely used. A framework of vertical frame members, known as mullions, and horizontal frame members is installed within an opening in the exterior wall of the building. Glazing panels are set within the openings defined by the vertical and horizontal frame members.

A common problem associated with such structures is that water running down the face of the adjacent condition tends to penetrate and drip into the open upper end of the vertical frame members and thus enter the building. This problem is particularly acute in the case of storefront and curtainwall framing systems installed in buildings constructed of masonry walls, for example, walls of pre-cast concrete. For aesthetic reasons vertical frame members of the storefront or curtainwall framing systems are frequently positioned to coincide with seams in the masonry walls. For example, a vertical frame member might be positioned beneath a seam between adjacent concrete panels. Water dripping down the face of the concrete wall tends to run along the seam and thus be directed into the open upper end of the vertical frame member.

The common solution for this problem is to install flashing over the open upper end of the vertical frame members. However, this solution is costly because it is labor intensive. Further, if the flashing is not properly installed, such as by a careless or unskilled worker, water can leak around the flashing and into the open upper end of the frame member.

Thus there is a need for a system which prevents water from entering the open upper end of a vertical frame member in a storefront framing system where the arrangement is not labor intensive and can be easily and effectively installed by unskilled labor.

SUMMARY OF THE INVENTION

Stated generally, the present invention comprises an improved anchor for fastening a vertical frame member to an adjacent condition and for preventing water from entering the opening in the frame member and for diverting water away from the opening. The anchor is easy to install, is not labor intensive, and can be effectively installed even by unskilled labor.

Stated more specifically, in a first aspect the present invention comprises an apparatus for anchoring a vertical frame member to an adjacent condition and for diverting water away from an opening in the frame member. The apparatus includes a mounting bracket and a water diverter attached to the mounting bracket. A downward extending flange connected to the water diverter is configured to engage the frame member. When the mounting bracket is attached to the adjacent condition and the flange engages the frame member, the water diverter overlies the opening in the frame member to prevent water from entering the opening and to divert water away from the opening.

In the disclosed embodiment the flange engages the frame member by a close tolerance fit. In one embodiment the flange engages a channel defined by opposed protrusions located within the opening of the frame member. In other embodiments the flange engages the walls defining the opening of the frame member. Various cross-sectional configurations of flanges are disclosed.

In a second aspect the present invention comprises a wall framing system including a frame member attached to an adjacent condition by an anchor of the type previously described.

Thus it is an object of the present invention to provide an improved means for anchoring a vertical frame member to an adjacent condition.

It is another object of the present invention to provide an improved means for preventing water from entering the opening of a hollow vertical frame member.

Another object of the present invention is to provide an improved means for preventing water from entering the opening of a hollow vertical frame member whose installation is not labor intensive.

Still another object of the present invention is to provide an improved means for preventing water from entering the opening of a hollow vertical frame member which can be effectively installed even by unskilled labor.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 2:
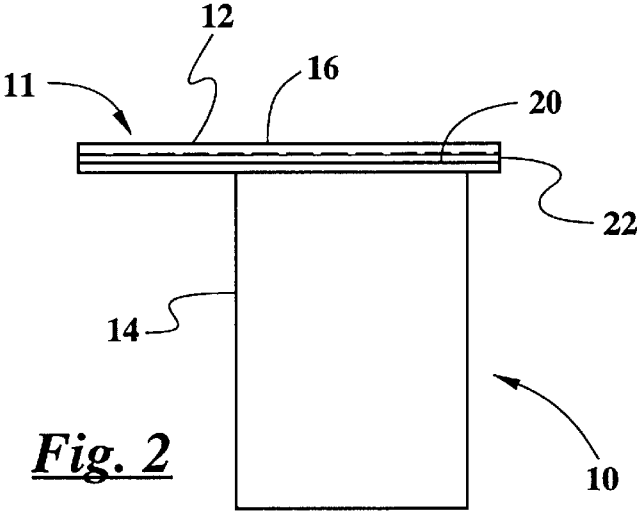
FIG. 2 is a side view of the mullion anchor of FIG. 1.
Figure 1:
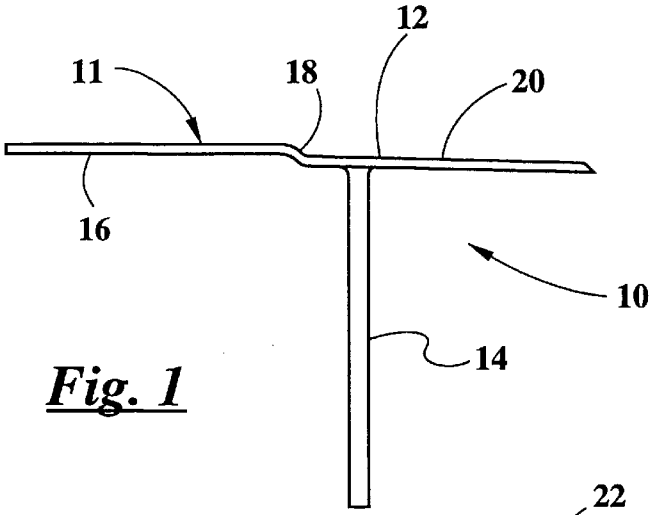
FIG. 1 is a front view of a mullion anchor with integral water diverter according to a disclosed embodiment of s the present invention.
Figure 3:
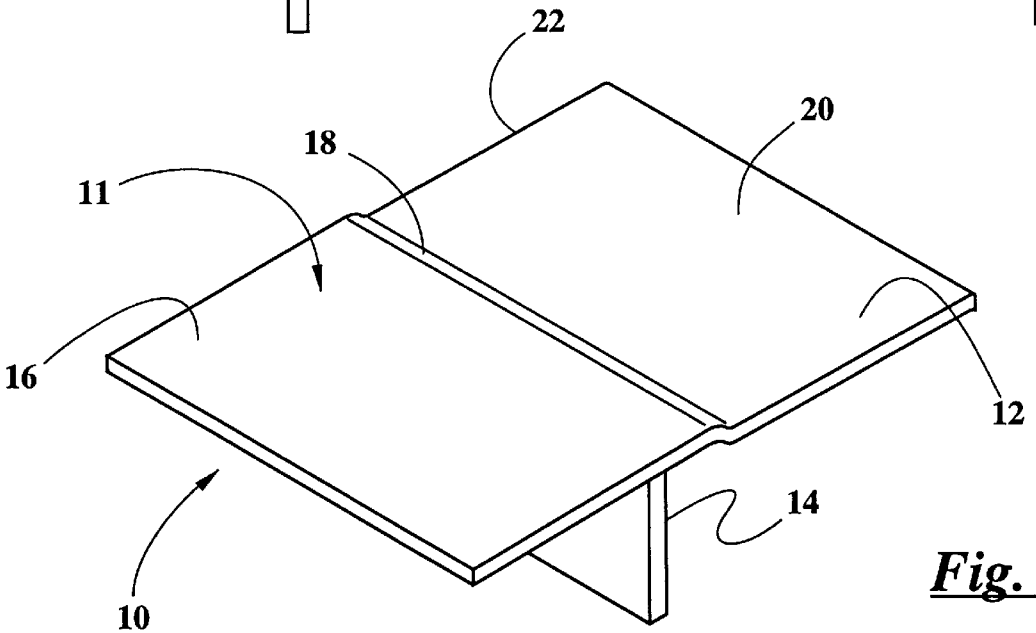
FIG. 3 is a perspective view of the mullion anchor of FIG. 1.

Referring now to the drawings, in which like numerals indicate like elements throughout the several views, FIGS. 1–3 show a mullion anchor 10 with integral water diverter according to an embodiment of the present invention. The anchor 10 comprises a head 11 having a stepped upper surface 12. The head 11 comprises a mounting bracket 16 at one end and a water diverter surface 20 at the opposite end. The mounting bracket 16 is essentially horizontal. A shoulder 18 extends from the forward edge of the head 11 to the rear edge and slopes downward from the edge of the mounting bracket 16 to the water diverter surface 20. The upper surface of the water diverter 20 slopes gently downward and away from the shoulder 18.

A flange 14 extends downward from the lower surface of the head 11 and adjacent the back edge 22 thereof. The upper end of the flange 14 is mounted to the lower surface of the water diverter 20. The flange 14 is elongated in horizontal cross-section and has a major horizontal axis which extends substantially parallel to the shoulder 18. In the disclosed embodiment the rear edge of the flange 14 is set forward from the rear edge 22 of the head 11.

Figure 4:
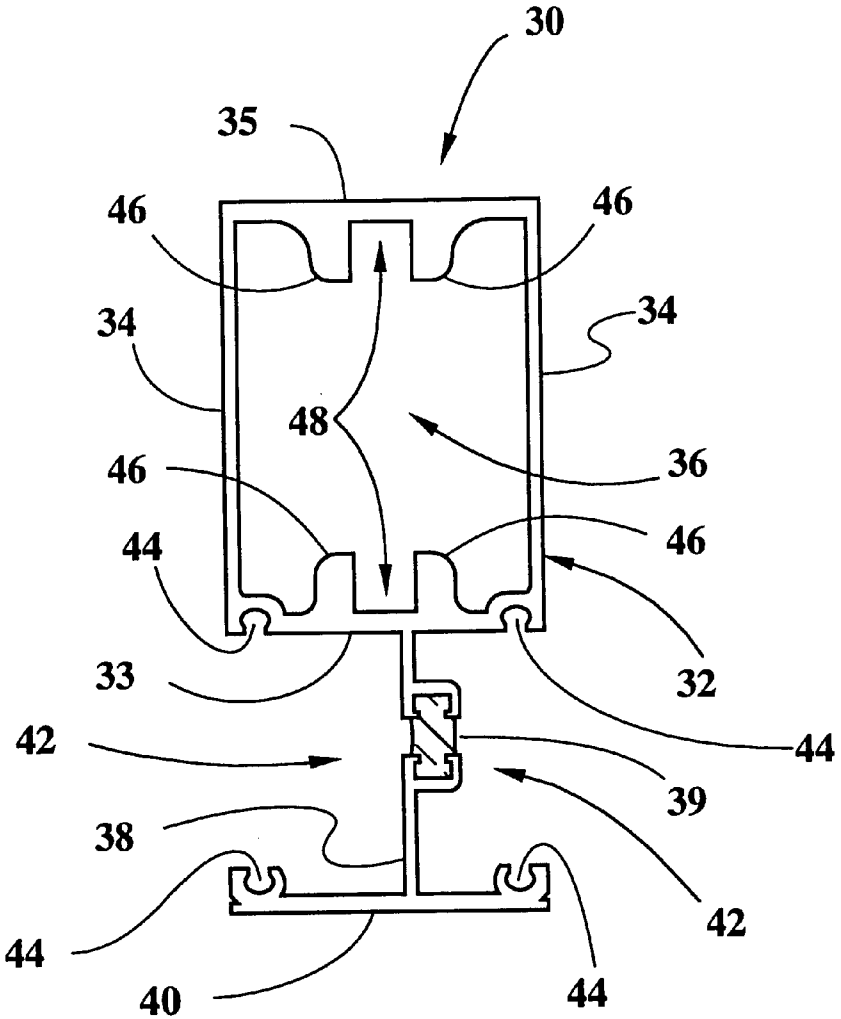
FIG. 4 is a top view of a vertical mullion according to a disclosed embodiment of the present invention.

FIG. 4 depicts a mullion 30 with which the mullion anchor with integral water diverter 10 of the first embodiment is intended to be used. The mullion 30 forms a tubular portion 32 consisting of a front wall 33, side walls 34, and a back wall 35 which define an opening 36. A web 38 extends forward from the front wall 33 and has a thermal break 39. A transverse flange 40 is joined at approximately its midpoint to the forward edge of the web 38. Glazing pockets 42 are defined on opposite sides of the web 36 between the front wall 33 and the rear face of the transverse flange 40. Gasket raceways 44 are defined on the front wall 33 and the rear face of the transverse flange 40 facing into the glazing pockets 42.

Within the opening 36 of the mullion 30, opposed pairs of protrusions 46 define mutually facing channels 48. The channels 48 are configured to receive the flange 14 of the anchor 10 snugly therewithin.

Figure 5:
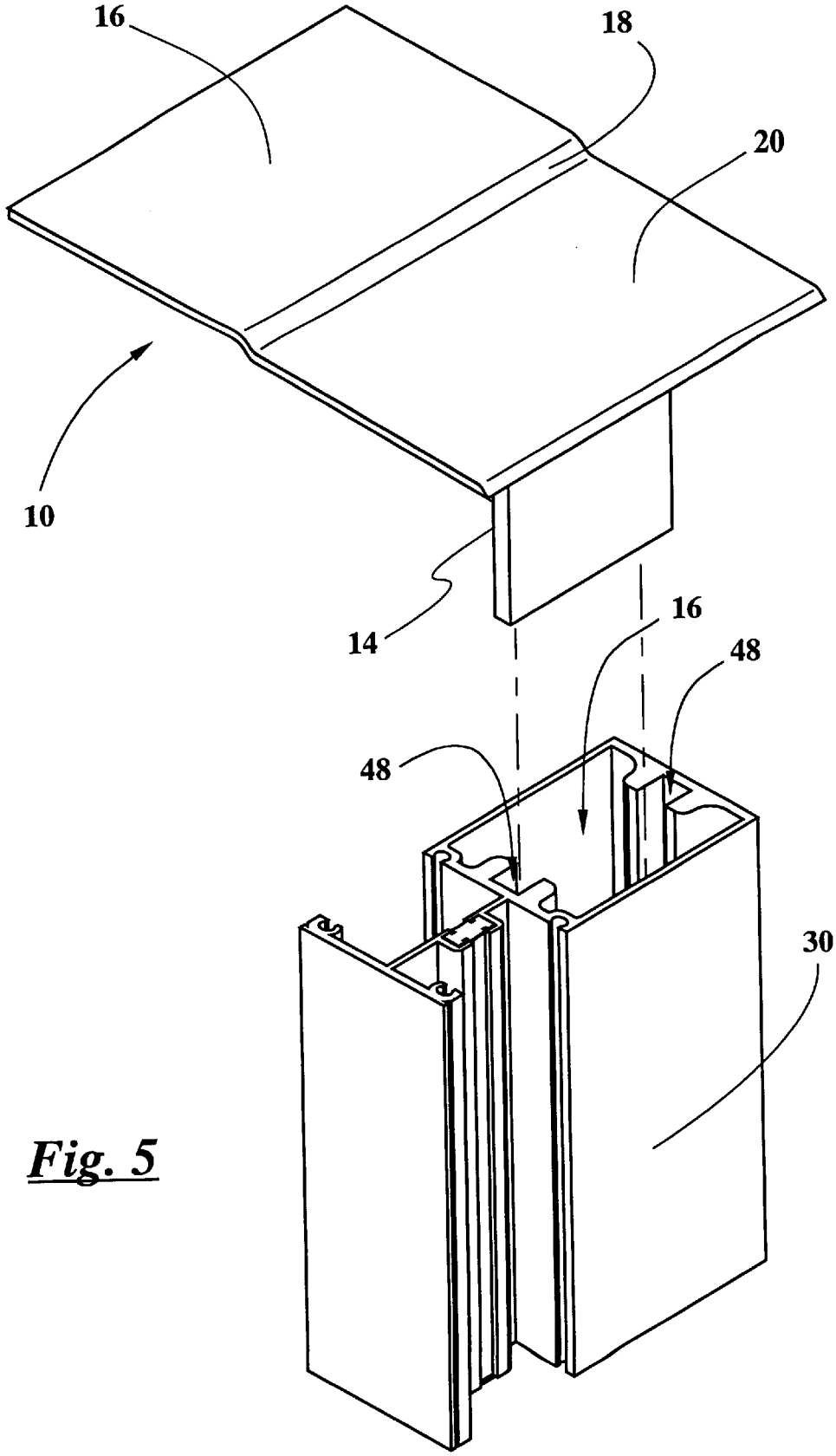
FIG. 5 is a perspective view of the mullion anchor of FIG. 1 positioned above the mullion of FIG. 4 in anticipation of the anchor being assembled onto the mullion.
Figure 6:
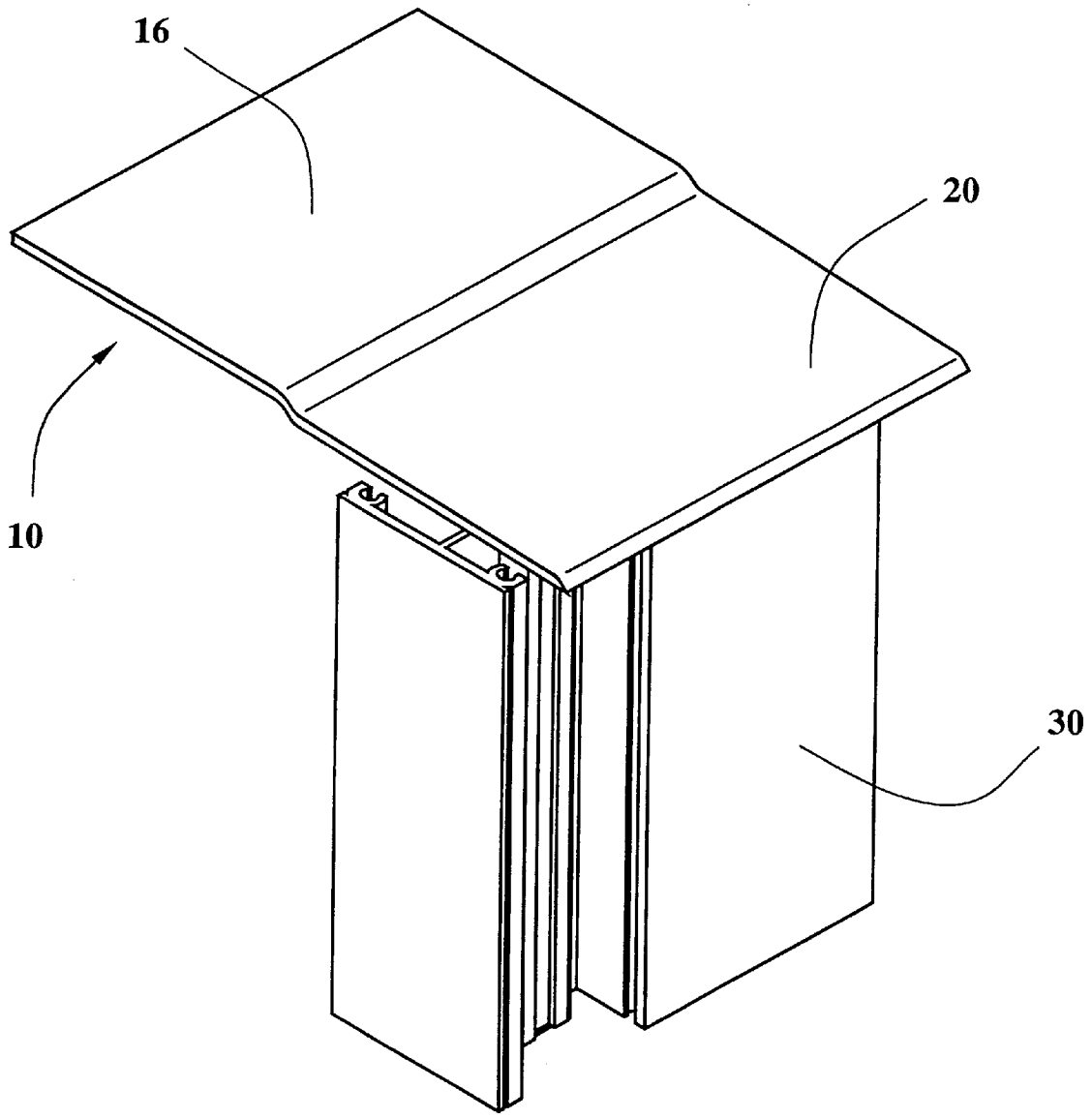
FIG. 6 is a perspective view showing the mullion anchor and mullion of FIG. 5 assembled together.

FIGS. 5 and 6 illustrate the assembly of the anchor 10 into the upper end of the mullion 30. The flange 14 of the anchor 10 slides into the channels 48 and is held in place by a close tolerance fit. When the anchor 10 is advanced down onto the mullion 30, the water diverter 20 overlies the entire opening 36 of the mullion. The mounting bracket 16 extends laterally with respect to the mullion 30.

Figure 7:
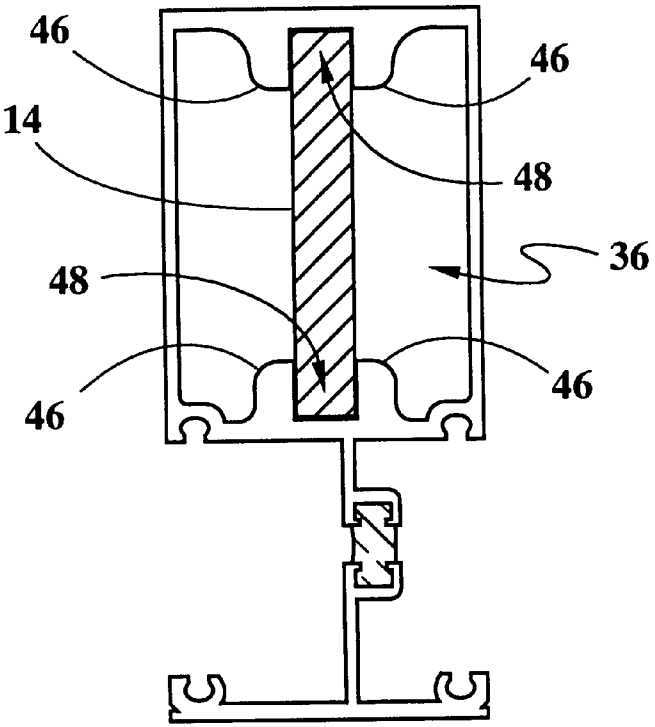
FIG. 7 is a horizontal section view of the mullion anchor and mullion assembly of FIG. 6.

FIG. 7 shows the manner in which the flange 14 of the anchor 10 engages the frame member 30. Opposing lateral edges of the flange 14 engage the channels 48 defined by the protrusions 46. Preferably the flange 14 snugly engages the channels 48 in a close tolerance fit.

Figure 8:
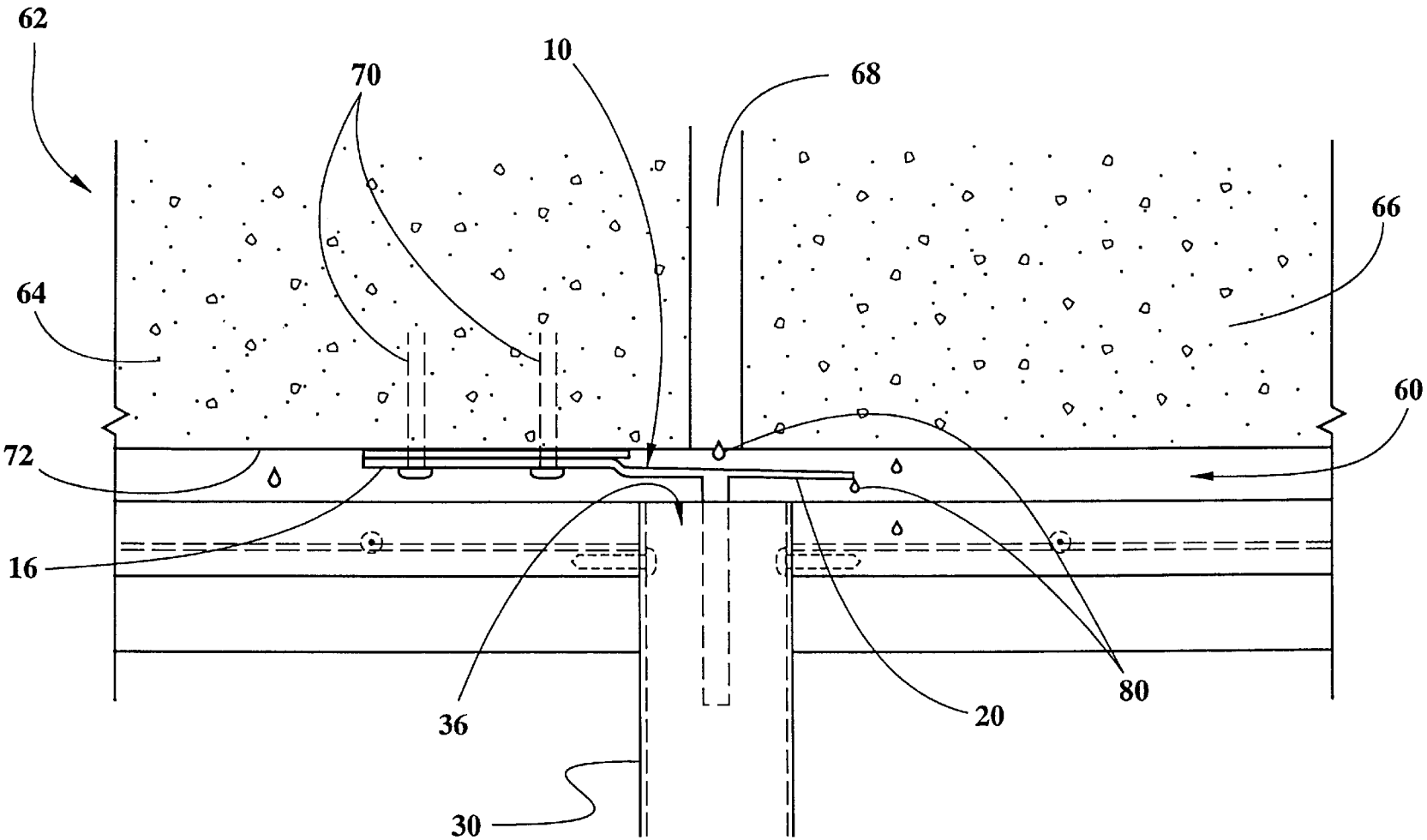
FIG. 8 is a front view showing the mullion anchor and mullion assembly of FIG. 5 mounted within an opening in a wall fabricated from concrete panels.
Figure 9:
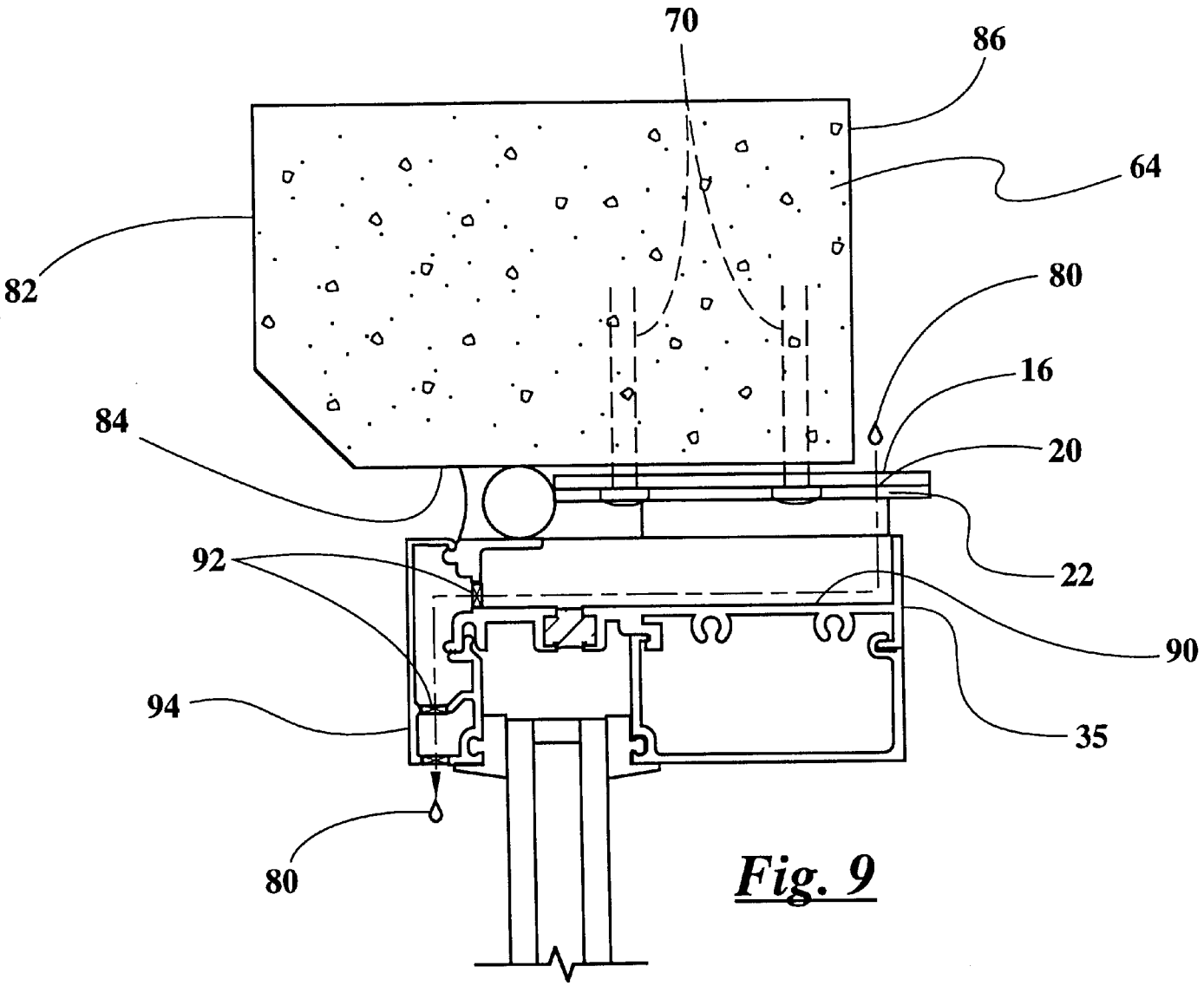
FIG. 9 is a side view of the structure of FIG. 8.

FIGS. 8 and 9 show a mullion 30 mounted within an opening 60 in a building wall 62. The building wall 62 includes adjacent concrete panels 64, 66, having a joint 68 therebetween. The bottom edges of the panels 64, 66 define the upper wall of the window opening 60. The anchor 10 is installed into the upper end of the mullion 30 as explained above with respect to FIGS. 5 and 6. The mullion 30 is positioned beneath the joint 68, and threaded fasteners 70 are inserted through the mounting bracket 16 of the anchor 10 and into the bottom 72 of the concrete slab 64. The water diverter 20 of the anchor 10 is disposed beneath the joint 68 and overlies the opening 36 at the upper end of the mullion 30. As seen in FIG. 9, the rear edge 22 of the water diverter 20 extends rearward of the back wall 35 of the mullion 30.

The operation of the mullion anchor 10 with integral water diverter 20 will now be explained with further reference to FIGS. 8 and 9. The anchor 10 anchors the upper end of the mullion 30 within the window opening 60. Because there is sliding engagement between the flange 14 of the anchor and the channels 48 of the mullion 30, variations in the length of the mullion are easily accommodated. Further, the sliding relationship between the anchor 10 and the mullion 30 allows for expansion and contraction of the mullion, which because of its metal composition will expand and contract at a different rate than the surrounding concrete structure.

Because the water diverter 20 overlies the entire upper end of the mullion 30, any water 80 which drips down or penetrates the exterior face 82 of the concrete panels 64, 66 and drips along the bottom edges 84 of the panels will be prevented from entering the opening 36 of the mullion. Instead the water will fall onto the water diverter 20, where the gently sloping upper surface of the water diverter will channel the water beyond the side wall 34 of the mullion. Similarly, any moisture which condenses on the interior face 86 of the panels 64, 66 and drips downward will also fall onto the water diverter 20 and be channeled away from the opening 36 of the mullion 30.

FIG. 9 illustrates the path the diverted water follows after dripping off the free edge of the water diverter 20. In the disclosed embodiment the water 80 drips off the edge of the water diverter 20 and into the upper end of a header 90. The header 90 is configured to channel the water toward the exterior of the building, where the water 80 exits through weep holes 92 in the header and an exterior cover member 94 mounted to the forward end of the header.

Figure 10:
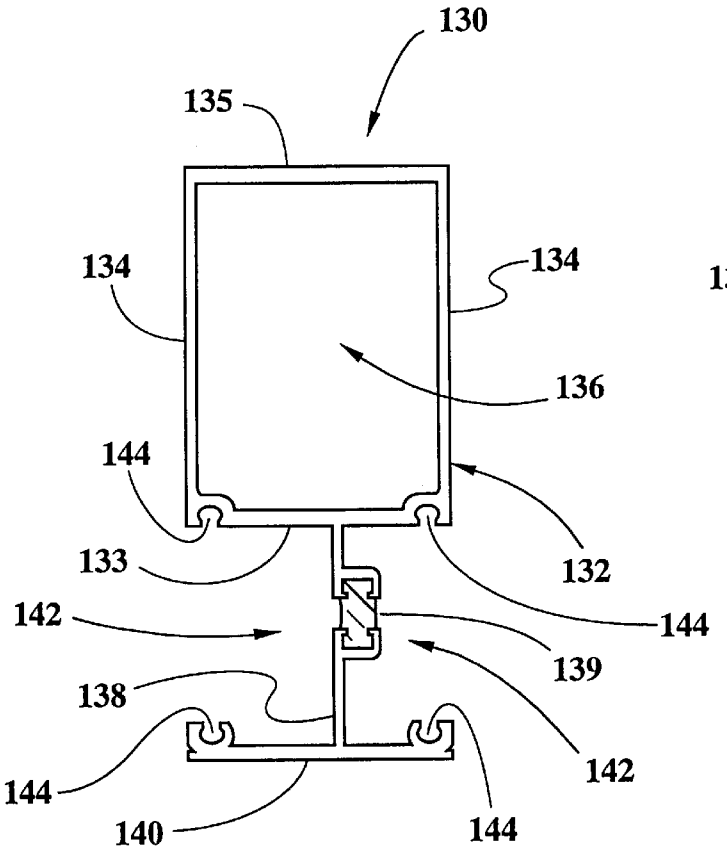
Fig. 10 PRIOR ART
FIG. 10 is a top view of a prior art vertical mullion.

While the foregoing embodiment has been described with respect to a mullion which is specially adapted to receive the flange 14 of the anchor 10, it will be appreciated that the same principle can be applied to prior art mullions which are not specially configured to receive the anchor. FIG. 10 depicts a prior art mullion 130 with which alternate embodiments of the mullion anchor with integral water diverter are intended to be used. The mullion 130 includes a tubular portion 132 consisting of a front wall 133, side walls 134, and a back wall 135 which define an opening 136. A web 138 extends forward from the front wall 133 and has a thermal break 139. A transverse flange 140 is joined at approximately its midpoint to the forward edge of the web 138. Glazing pockets 142 are defined on opposite sides of the web 136 between the front wall 133 and the rear face of the transverse flange 140. Gasket raceways 144 are defined on the front wall 133 and the rear face of the transverse flange 140 facing into the glazing pockets 142.

Figure 12:
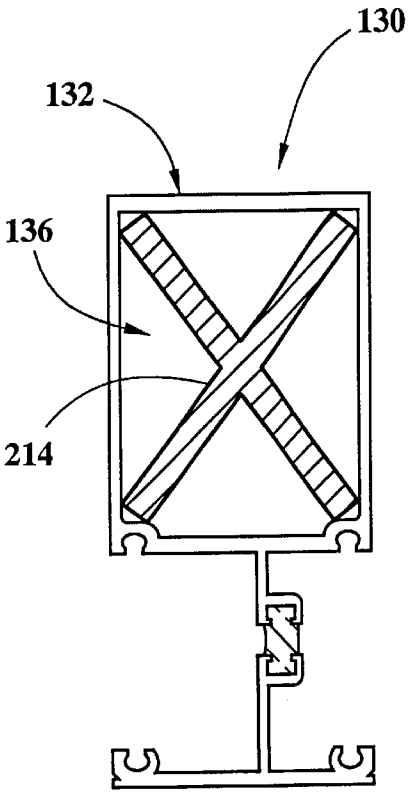
FIG. 12 is a horizontal section view showing a second alternate arrangement of a mullion anchor mounted to the upper end of a prior art mullion.
Figure 11:
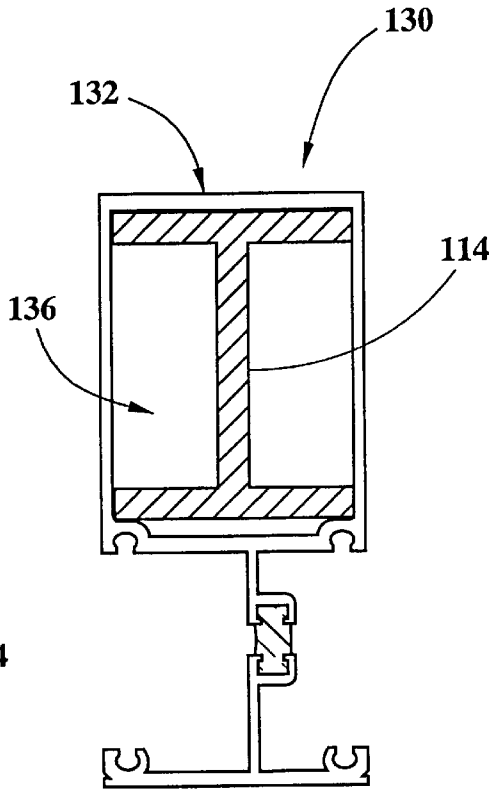
FIG. 11 is a horizontal section view showing a first alternate arrangement of a mullion anchor mounted to the upper end of a prior art mullion.

Whereas the mullion 30 included flanges 46 defining opposing channels 48 within the opening 36 to receive a flange 14 which is essentially planar, the mullion 130 includes no such special internal configuration. Instead, the flange of the anchor is configured to adapt to the opening 136 of the mullion 130. In FIG. 11, for example, a second embodiment of an anchor 110 includes a flange 114 arranged in the shape of an "H," with the legs of the "H" bearing against the inside of the front and back walls of the mullion. In FIG. 12, a third embodiment of an anchor 210 includes a flange 214 is arranged in the shape of an "X," with the four points of the X engaging the four comers of the opening 136 of the mullion 130. Other flange configurations which create a close tolerance fit with walls of the mullion will be readily apparent. While the flanges 114, 214 of these alternate configurations 110, 210 are probably more difficult and expensive to fabricate, any additional expenses may be offset by the advantages of not requiring a specially configured mullion.

The anchors 10, 110, 210 with integral water diverter provides a number of advantages over prior art mullion anchors. The incorporation of the integral water diverter into the anchor 10, 110, 210 avoids the necessity of installing flashing to prevent water from entering the opening 36, 136 of the mullions 30, 130. Not only does this eliminate a labor-intensive step but also it prevents the possibility of the flashing being improperly installed. Further it eliminates the requirement of maintaining separate inventories of anchors and flashing.

While the flanges 14, 114, and 214 of the disclosed embodiments are joined to the lower surface of the water diverter 20, the present invention also contemplates the possibility of a flange which extends downward from the mounting flange 16, so long as the flange engages the frame member with the water diverter overlying the opening in the frame member. Stated differently, the present invention contemplates the flange being attached to the water diverter by way of the associated mounting bracket.

Also, while the flanges 14, 114, 214 of the disclosed embodiments are all configured to engage the associated frame member by way of a close tolerance fit, the present invention is also intended to cover a flange which is connected to the associated frame member by a separate fastening means, such as a rivet, bolt, screw, adhesive, weld, or other suitable fastening means.

Finally, it will be understood that the preferred embodiment has been disclosed by way of example, and that other modifications may occur to those skilled in the art without departing from the scope and spirit of the appended claims.

What is claimed is:

1. An apparatus comprising:

a wall defining a wall opening therein, a portion of said wall which defines the upper edge of said wall opening comprising an upper wall of said wall opening;

an anchor including a mounting bracket fastened to said upper wall of said wall opening, a water diverting member attached to said mounting bracket, and a flange extending downward from one of said water diverting member or said mounting bracket; and an elongated frame member defining an upwardly exposed opening therethrough, said frame member comprising flange engagement means at an upper end of said frame member which flange engagement means are engaged by said flange of said anchor, whereby said upper end of said frame member is attached to said wall;

said water diverting member overlying said opening in said frame member so as to prevent water from entering said opening and to divert water away from said frame member.

2. The apparatus of claim 1, wherein said flange extends downward from said water diverting member.

3. The apparatus of claim 1, wherein said flange of said anchor engages said flange engagement means of said frame member by way of a close tolerance fit.

4. The apparatus of claim 3, wherein said flange engagement means comprises means defining an opposing pair of channels formed within said opening of said frame member, corresponding edges of said flange being received within said channels.

5. The apparatus of claim 4, wherein said flange is substantially planar.

6. The apparatus of claim 3, wherein said frame member comprises walls defining said opening, and wherein said flange engagement means comprises said walls defining said opening.

7. The apparatus of claim 6, wherein said flange is substantially H-shaped in cross-section.

8. The apparatus of claim 6, wherein said flange is substantially X-shaped in cross-section.

9. The apparatus of claim 1, wherein said flange of said anchor slidably engages said flange engagement means of said frame member, whereby said frame member is slidably movable with respect to said upper wall of said wall opening.

* * * * *